US009978351B1

(12) United States Patent
Krishnamachari

(10) Patent No.: US 9,978,351 B1
(45) Date of Patent: May 22, 2018

(54) MODULAR APPARATUS FOR SELF-SUPPORTED WIELDING OF MUSICAL INSTRUMENTS

(71) Applicant: Parashar Krishnamachari, San Jose, CA (US)

(72) Inventor: Parashar Krishnamachari, San Jose, CA (US)

( * ) Notice: Subject to any disclaimer, the term of this patent is extended or adjusted under 35 U.S.C. 154(b) by 0 days. days.

(21) Appl. No.: 15/411,902

(22) Filed: Jan. 20, 2017

(51) Int. Cl.
*G10G 5/00* (2006.01)

(52) U.S. Cl.
CPC ..... *G10G 5/005* (2013.01)

(58) Field of Classification Search
CPC ..... G10G 5/005; G10G 5/00; G10G 7/00
See application file for complete search history.

(56) References Cited

U.S. PATENT DOCUMENTS 3,894,464 A * 7/1975 Brooks ..... G10G 5/005 224/257
5,780,756 A * 7/1998 Babb ..... G10D 3/18 84/280
2005/0204894 A1* 9/2005 Dimbath ..... G10G 7/005 84/327

* cited by examiner

*Primary Examiner* — Kimberly Lockett
(74) *Attorney, Agent, or Firm* — Intellectual Property Law Group LLP

(57) ABSTRACT

A modular apparatus having at least two connecting members substantially at right angles from each other for self-supported wielding of musical instruments. The modular apparatus is worn over at least one shoulder and around the back of the user's neck while it is detachably connected to a musical instrument, such as a violin. The musical instrument is detachably connected to the modular apparatus via a support attachment, support, strap and fastening mechanism. The plurality of members allows even distribution of pressure and tension throughout the upper body caused by supporting and playing the musical instrument.

19 Claims, 8 Drawing Sheets

MODULAR APPARATUS FOR SELF-SUPPORTED WIELDING OF MUSICAL INSTRUMENTS

BACKGROUND OF THE INVENTION

1. Field of the Invention

The exemplary embodiment(s) of the present invention generally relates to musical instrument accessories. More specifically, the exemplary embodiment(s) of the present invention relates to an accessory comprising supporting straps used with musical instruments such as violins, violas, guitars, saxophones or the like.

2. Background

A principal problem for violinists/violists is that in order to play the instrument the instrument must be held entirely by friction through squeezing the instrument between the chin and shoulder. This causes a lot of tension and discomfort around the shoulder, neck and back region when holding the instrument. A solution to this problem has been reconstruction of the actual instrument to address the problem; however, this is only possible with electrical instruments and not acoustic ones because reconstruction of the instrument body affects the sound. While electrical instruments are acceptable for amplified environments, they are not appropriate for orchestral performances or any other acoustical performance. Furthermore, reconstruction is customized and cannot be used across-the-board with other instruments. It is costly and may not be suitable for novice or hobbyist musicians.

Guitarist, saxophonists or musicians that play instruments supported by a strap face similar problems in that all the weight of the instrument is centered on the neck causing significant tension and pain.

There exist tension-based techniques for supporting acoustic instruments; however, these techniques are inherently unstable and risk damaging the instrument. These techniques require at least some minimal effort from the musician to actively support the instrument. Furthermore, these techniques are not interchangeable with different kinds of instruments. Other attempts to solve the problem have resulted in weak clamping systems prone to slipping and use of multiple tools.

Accordingly, there is a need for a modular apparatus that can self-support a musical instrument with no effort by the user, is cost effective, does not affect the sound of the instrument, is interchangeable between instruments, is stable and does not damage the instrument, is easy to use and can effectively distribute weight to multiple areas of contact on the back and shoulders.

SUMMARY

According to an embodiment of the present invention, there is a modular apparatus for self-supporting a musical instrument. In one aspect, the apparatus comprises: a neck member, which is configured to hang from a neck, the neck member extending to a first shoulder member, which is configured to hang from a shoulder; the neck member and the first shoulder member are at about 90 degrees to each other; the neck member having a first side and a second side, the first shoulder member having a first side and a second side; and at least one support attachment on the second side of the neck member.

According to an embodiment of the present invention, there is a modular apparatus for self-supporting a musical instrument comprising: a neck member extending at about a 90 degrees to a first shoulder member and the neck member extending at about 90 degrees to a second shoulder member, the first shoulder member being a mirror image of the second shoulder member. Furthermore, the neck member, the first shoulder member, the second shoulder member each having a first side and a second side; and the neck member having at least one support attachment on the second side.

These features, advantages and other embodiments of the present invention are further made apparent, in the remainder of the present document, to those of ordinary skill in the art.

BRIEF DESCRIPTION OF THE DRAWINGS

In order to more fully describe embodiments of the present invention, reference is made to the accompanying drawings. These drawings are not to be considered limitations in the scope of the invention, but are merely illustrative.

DETAILED DESCRIPTION OF SPECIFIC EMBODIMENTS

Figure 1:
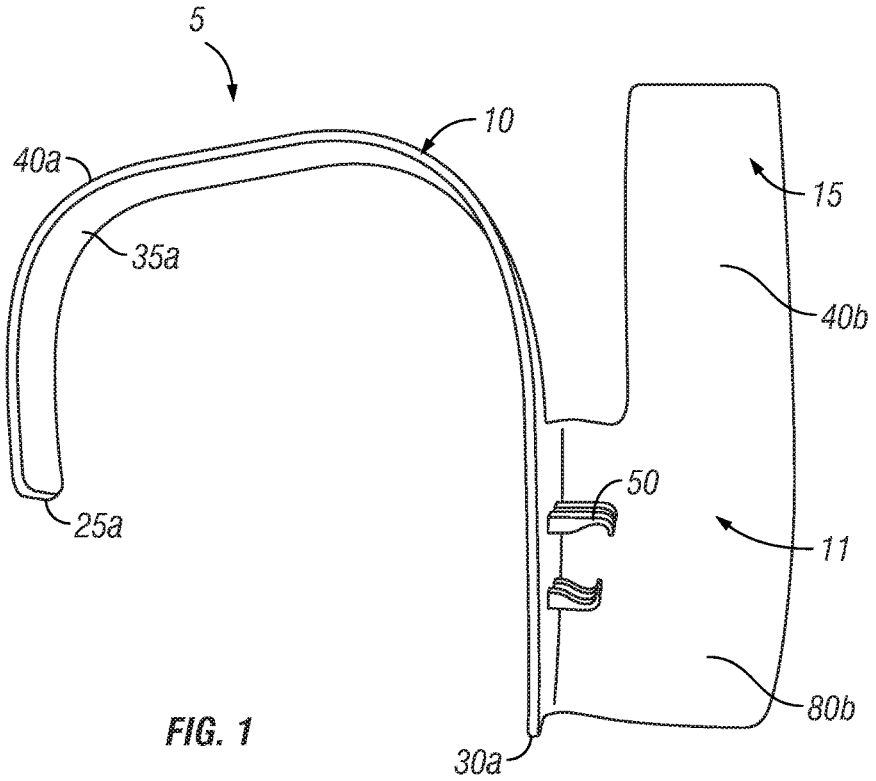
FIG. 1 illustrates a top view of the modular apparatus, according to an embodiment of the present invention.

The description above and below and the drawings of the present document focus on one or more currently preferred embodiments and also describe some exemplary optional features and/or alternative embodiments. The description and drawings are for the purpose of illustration and not limitation. Those of ordinary skill in the art would recognize variations, modifications, and alternatives. Such variations, modifications, and alternatives are also within the scope of the present invention. Section titles are terse and are for convenience only.

Throughout the description and drawings, example embodiments are given with reference to specific configurations. It will be appreciated by those of ordinary skill in the art that the present invention can be embodied in other specific forms. Those of ordinary skill in the art would be able to practice such other embodiments without undue experimentation. The scope of the present invention, for the purpose of the present patent document, is not limited merely to the specific example embodiments or alternatives of the foregoing description.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

According to embodiments of the present invention, the neck member is herein referred to as the first member, the first shoulder member is herein referred to as the second member and the second shoulder member is herein referred to as the third member. The weight of the violin 1 pushes the modular apparatus 5 downward against the user's body. The modular apparatus 5 works by distributing the weight of the instrument at multiple points of contact on the user's body, specifically the shoulders, back and neck, so the user does not have to actively support the instrument. This allows the user to maintain a relaxed posture and relieves tension by effectively distributing weight to multiple areas of contact between the modular apparatus 5 and user. The modular apparatus 5 reduces fatigue, stress and strain on specific areas, which allows a user to perform with a relaxed posture. This also allows more freedom of movement. There may be alternate attachments for different instruments on the modular apparatus 5.

FIG. 1 illustrates a top view of a modular apparatus 5, according to an embodiment. The modular apparatus 5 comprises a first member 10 having a first side of first member 35*a* and a second side of first member 40*a*, a first end of first member 25*a* and second end of first member 30*a*. The first member 10 of the modular apparatus 5 curves around the user's neck and the first side of the first member 35*a* faces the user and the second side of the first member 40*a* faces away from the user. The first side of the first member 35*a* can also be padded throughout to provide comfort to the user or it can be padded at certain regions. On the second side of the first member 40*a*, there is a fastening mechanism 45 which allows the strap 65 to fasten to (not shown, see FIG. 11).

The second member 15 comprises a first side of the second member 35*b* (not shown, see FIG. 2) which faces the user and a second side of the second member 40*b*. The second member 15 comprises a first end of the second member 25*b* (not shown, see FIG. 2) and a second end of the second member 30*b* (not shown, see FIG. 2). A support attachment 50 is located on the second side of the first member 40*a* substantially close to the second end of the first member 30*a*. The support attachment 50 can also be a sliding mechanism in other embodiments. The support attachment 50 removably engages with the support 55 (not shown, see FIG. 7) so that the support 55 is secure during the use of the modular apparatus 5 and in its proper orientation. The support 55 sits on the support portion 11 of the modular apparatus 5. The support portion 11 has a first side of support portion 80*a* (not shown, see FIG. 4) which faces the user and a second side of the support portion 80*b*, which faces away from the user. The first member 10 extends to a second member 15 which curves around the user's left shoulder.

The modular apparatus 5 may be structured in a variety of sizes, each size shaped to fit users with different heights and weights. The modular apparatus 5 will not be completely rigid, rather it can be flexible and can mold to the shape of the user's body. The modular apparatus 5 can be made of elastomers or carbon fiber materials. In one aspect, the modular apparatus 5 may be formed of a flexible material or a material having elasticity.

Figure 2:
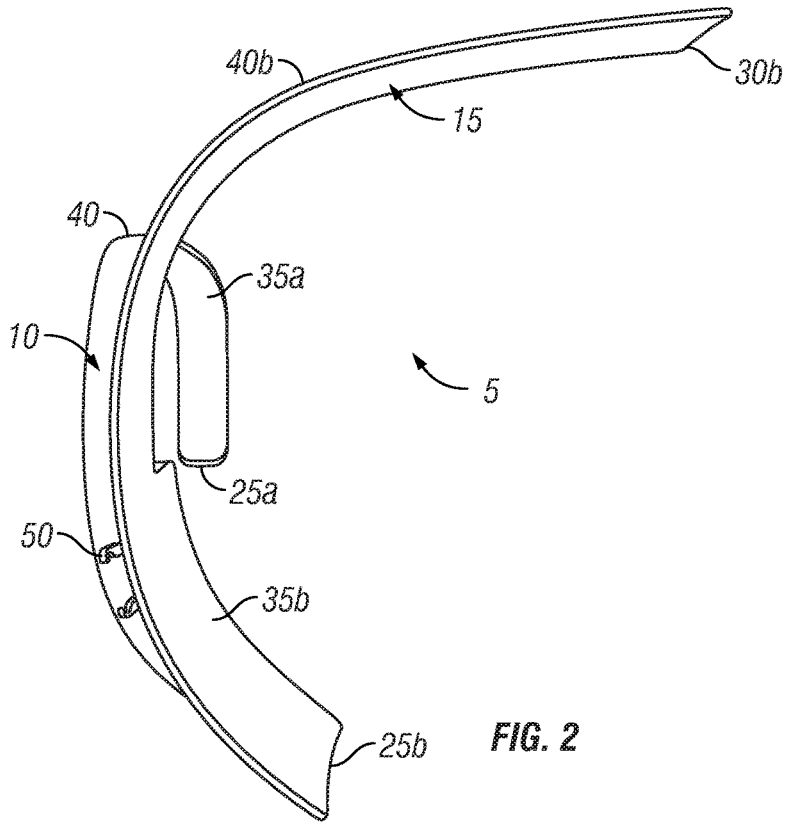
FIG. 2 illustrates a right side view of the modular apparatus, according to an embodiment of the present invention.

FIG. 2 illustrates a side view of a modular apparatus 5, according to an embodiment. The modular apparatus 5 comprises a second member 15 that is shaped to fit over the shoulder of the user. In some embodiments, the shape of the second member 15 can be formed to fit adult men or women's shoulders and in other embodiments, the shape of the second member 15 can be formed to fit children's shoulders. The second member 15 has a first end of the second member 25*b* and a second end of second member 30*b*. In one aspect, the second member 15 can also be padded on the first side of the second member 35*b* to provide comfort to the user. The padding can be throughout the first side of the second member 35*b* or just portions. On the opposing side of the first side of the second member 35*b* is the second side of the second member 40*b*, which faces away from the user's body. FIG. 2 further illustrates the support attachment 50 located on the second side of the first member, slightly above the region where the first member 10 extends and become the second member 15.

Figure 3:
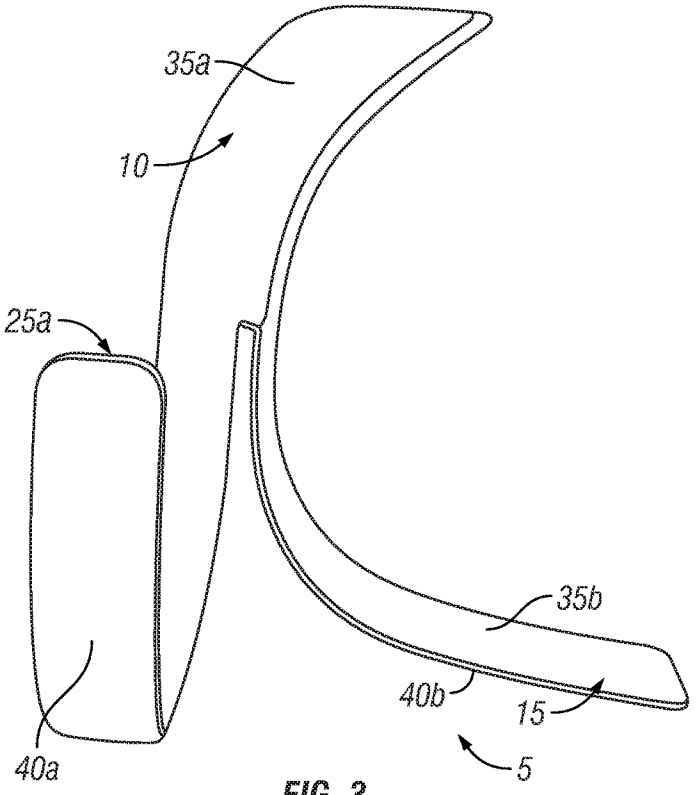
FIG. 3 illustrates a left side view of the modular apparatus, according to an embodiment.

FIG. 3 illustrates yet another side view of a modular apparatus 5, according to an embodiment. The first member 10 is formed to comfortably curve around the neck of the user. In some embodiments, the curvature of the first member 10 can be shaped to fit men or women. In other embodiments, the curvature of the first member 10 can be shaped to fit children. The first side of the first member 35*a* and the second side of the first member 40*a* can be smooth. Similarly, the first side of the second member 35*b* and second side of second member 40*b* can be smooth.

In another embodiment, the modular apparatus 5 is symmetrical and has a second member 15 and a third member 20 that curves over a left and a right shoulder, respectively of the user. The third member 20 is parallel with the second member 15 and extends from the second side of the first member 40*a* at the first end of the first member 25*a*. There are alternate attachments for different instruments in the symmetrical embodiment of the modular apparatus 5. The alternate attachments have a second support attachment 50 located on the second side of the first member 40*a* close to the first end of the first member 25*a*. In the symmetrical embodiment of the modular apparatus 5, both supports 55 have a straplock button located on the surface opposite the support attachment holes 60 of each support 50. A user will then connect a hole from the strap to each straplock button. In another embodiment, the straplock button can be connected directly onto the modular apparatus 5 by a bolt. Once the strap is connected to each straplock button, the user can then attach the musical instrument to the free end of the strap.

Figure 4:
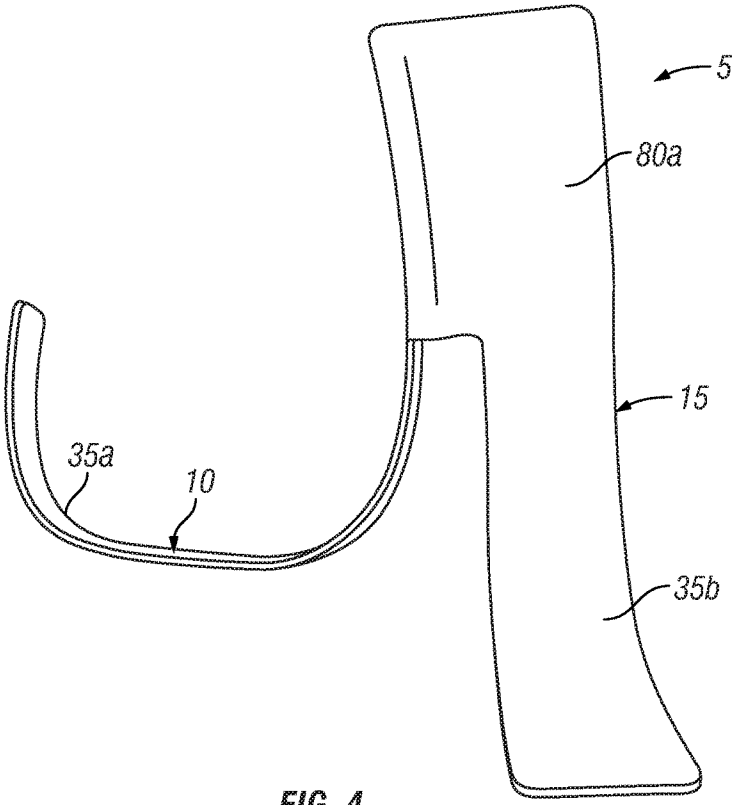
FIG. 4 illustrates a bottom view of the modular apparatus, according to an embodiment.

FIG. 4 illustrates a bottom view of a modular apparatus 5, according to an embodiment. The first member 10 is substantially perpendicular to the second member 15. This allows the modular apparatus 5 to fit comfortably on the user's shoulder while also curving around the user's neck. The smoothness of the first side of the first member 35*a*, the first side of the second member 35*b*, and the first side of the support portion 80*a* allows the modular apparatus 5 to sit substantially flush against the user's body. As mentioned above, cushioning can be added to the first side of the first member 35*a*, the first side of the second member 35*b*, and the first side of the support portion 80*a* to provide comfort.

Figure 5:
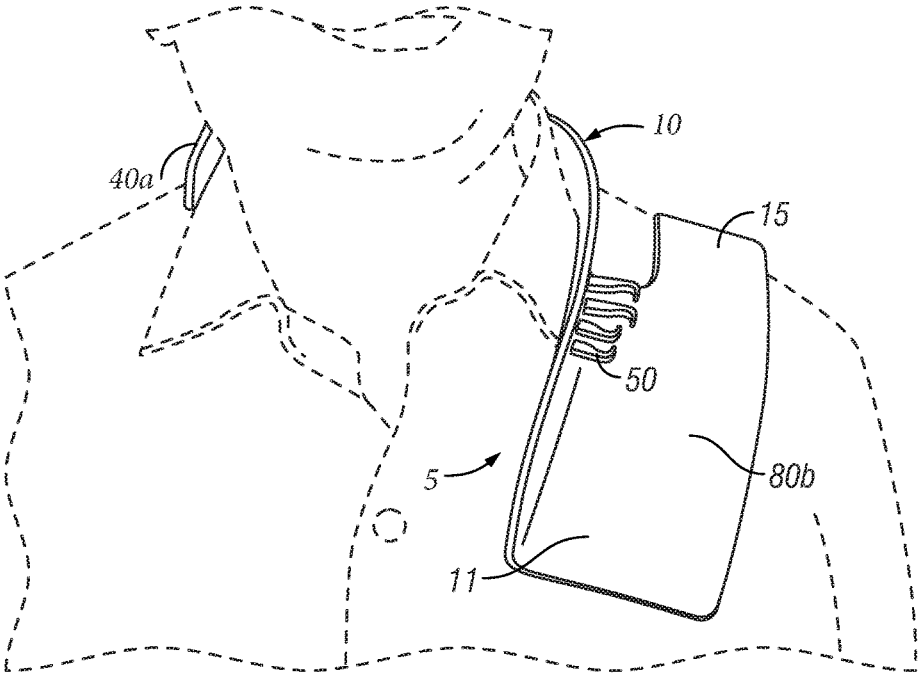
FIG. 5 illustrates a front view of the modular apparatus worn by a user, according to an embodiment.

FIG. 5 illustrates a front view of a modular apparatus 5 worn by a user, according to an embodiment. In one aspect, the support portion 11 does not have a support 55 detachably connected to the support attachment 50. Typically, when the modular apparatus 5 is in use, the support 55 sits on the second side of the support portion 80*b* while also being detachably connected to the support attachment 50. As show in FIG. 5, the first member 10 curves around the user's neck and the second member 15 extends over the user's shoulder and down the user's back.

For the symmetrical embodiment of the modular apparatus 5, a third member 20 also extends over the user's right shoulder and down the user's back. The symmetrical embodiment also comprises a support attachment 50 on the opposite end of the second side of the first member 40*a*. The symmetrical embodiment, can be used with larger instruments such as guitars or saxophones or other instruments supported by straps. A guitar strap can be connected to each second member 15 and third member 20 via a strap-lock button. The guitar will be supported by the user's shoulder rather than just the neck and back. The advantage when using the modular apparatus 5 with larger instruments is that more than one part of the user's body is involved in supporting the weight of the instrument, thereby reducing the stress on any one particular area of the body.

The symmetrical embodiment of the modular apparatus 5 can also support equipment such as camera equipment by simply exchanging the support attachment 50 to a different type of attachment that detachably connects to the equipment. When the equipment becomes heavier, a reinforcement element can run horizontally across the user's back connecting the second member 15 and the third member 20.

Figure 6:
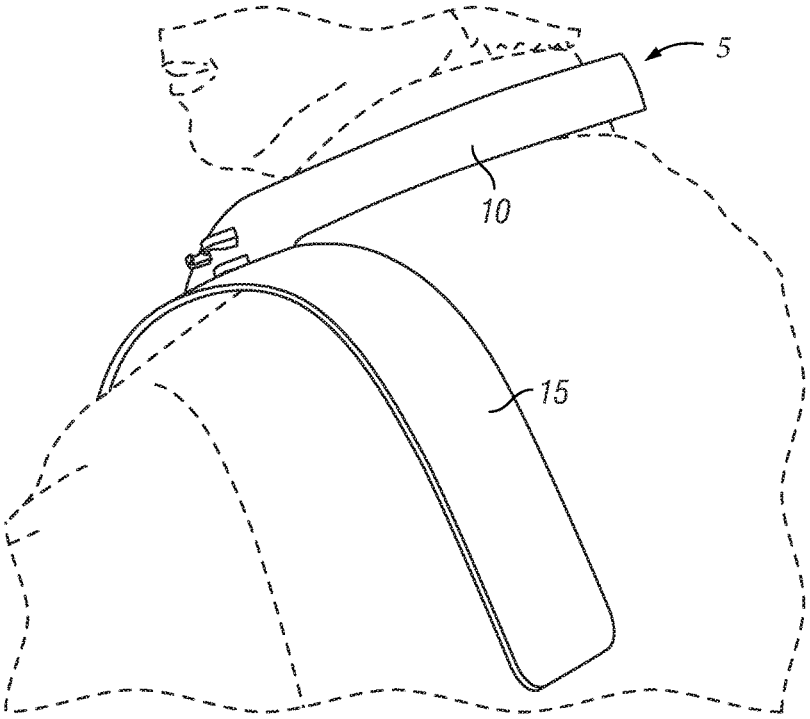
FIG. 6 illustrates a side perspective view of a modular apparatus worn by a user, according to an embodiment.

FIG. 6 illustrates a side perspective view of a modular apparatus 5 worn by a user, according to an embodiment. The first member 10 is shown to curve around the user's neck to provide support to the user when playing the violin 1. The second member 15 is shown to curve over the user's left shoulder and down the user's back when the user is playing the violin 1. A modular apparatus 5 can be symmetrical in that there can be a third member 20 parallel to the second member 15 on the opposing side of the first member 10. The symmetrical embodiment is versatile because both right-handed and left-handed users can use one modular apparatus 5.

Figure 7:
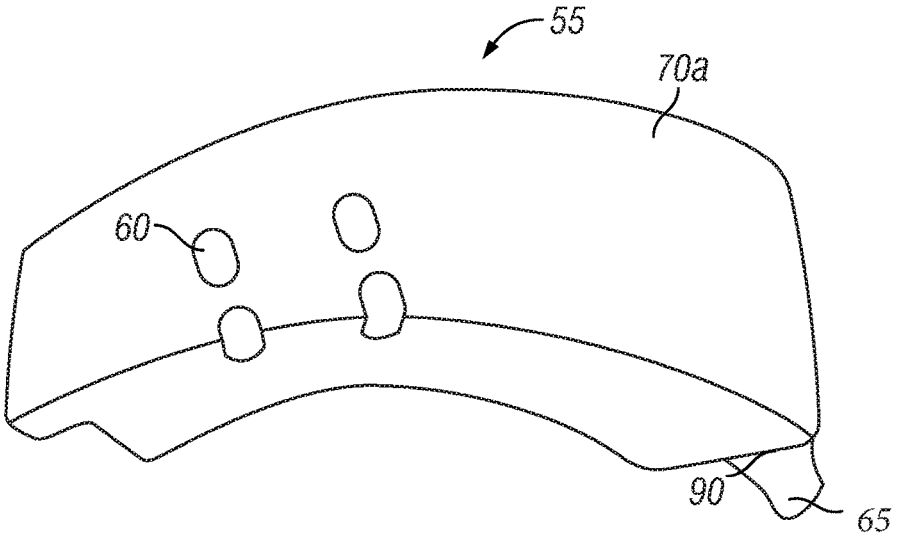
FIG. 7 illustrates a first surface of a support of the modular apparatus, according to an embodiment.

FIG. 7 illustrates a support 55 having a first surface of a support 70*a*, according to an embodiment. The first surface of a support 70*a* is the user facing side of the support 55. The first surface of a support 70*a* comprises the support attachment holes 60. The support 55 can be structured of various shapes depending on the angle at which the user wants the violin 1 to sit when the user is playing. The support 55 can be made of various materials such as gel, rigid plastic, wood, or carbon-fiber reinforced plastic. The support 55 ensures proper alignment of the instrument. Additional padding for the support 55 can be added or removed depending on the preference of the user or whether the chinrest clamps 85 (not shown, see FIG. 9) are center-mounted or side mounted on the violin 1. For example, if the user has longer arms, additional padding can be added to the second surface of the support 70*b* (not shown, see FIG. 8) to further extend the violin 1 away from the user's chin. At the front facing portion of the support 55, the strap 65 is attached to the support 55, for example, by a loop 90.

Figure 8:
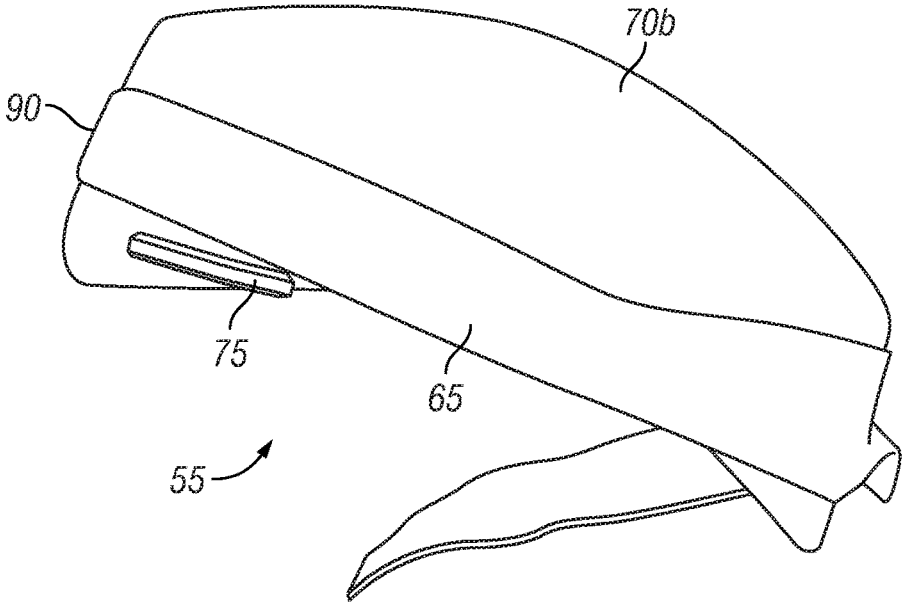
FIG. 8 illustrates a second surface of the support of the modular apparatus having a tension mechanism and a strap, according to an embodiment.

FIG. 8 illustrates a support 55 having a second surface of a support 70*b*, at least one tension mechanism 75 and a strap 65, according to an embodiment. The second surface of a support 70*b* is the instrument facing surface. The tension mechanism 75 is releasable from the support 55. When the strap 65 is pulled from the support loop 90, the user can create tension against the strap 65 by inserting the tension mechanism 75 over the strap 65 and into the support 55. A second tension mechanism 75 can be inserted on the opposing end of the second surface of the support 70*b*. The strap 65 can be about 40.5 to 43.5 inches long.

Figure 9:
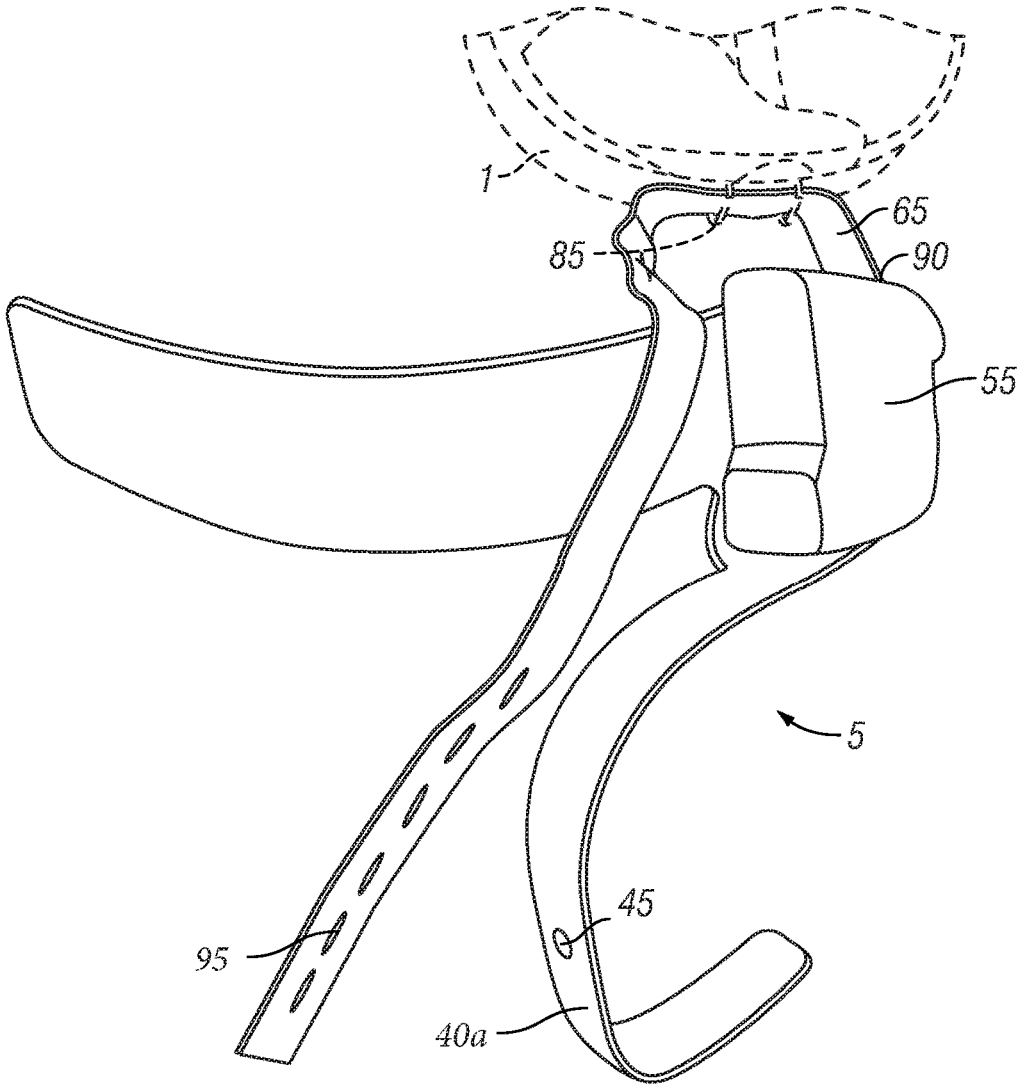
FIG. 9 illustrates a partial view of an assembled modular apparatus attached to a violin via a strap, according to an embodiment.

FIG. 9 illustrates an assembled modular apparatus 5 attached to a violin 1 via a strap 65, according to an embodiment that is connected to the support 55 by a support loop 90. The modular apparatus 5 comprises the support 55 on the support portion 11 of the modular apparatus 5. The strap is threaded through the chinrest clamps 85 on the violin 1 and when the proper tension is found, the tension mechanism 75 is inserted into the support 55. Then the strap 65 is further pulled until it reaches and is secured to the fastening mechanism 45 located on the second side of the first member 40*a*.

Figure 10:
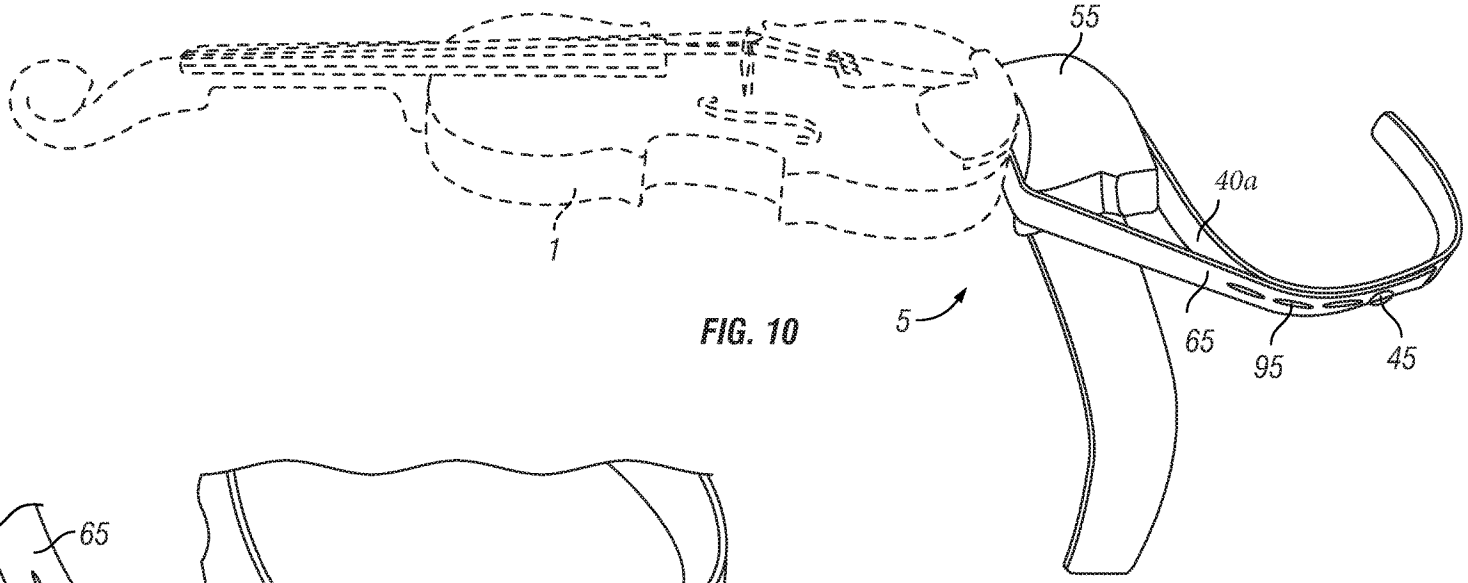
FIG. 10 illustrates a top perspective view of an assembled modular apparatus and violin, according to an embodiment.

FIG. 10 illustrates a perspective view of an assembled modular apparatus 5 and violin 1, according to an embodiment. Once the user agrees to a comfortable position for the violin to sit against the support 55, the strap 65 is then fully threaded through the clamps 85 (not shown, see FIG. 9) of the chinrest with the tension mechanism 75 in place. Then, the user will connect the strap 65 to the fastening mechanism 45 located on the second side of the first member 40*a*.

Figure 11:
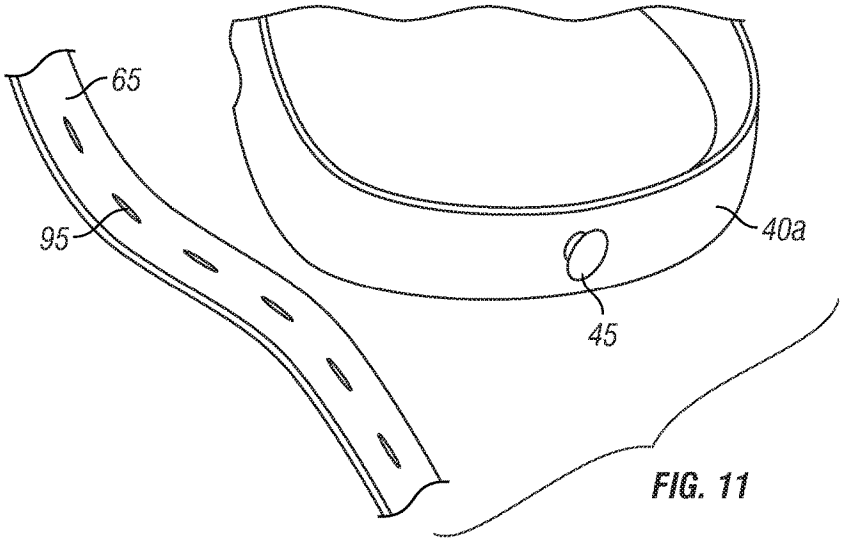
FIG. 11 illustrates a partial view of a strap and a fastening mechanism of the modular apparatus, according to an embodiment.

FIG. 11 illustrates a strap 65 and a fastening mechanism 45, according to an embodiment. The strap 65 comprises a plurality of holes 95 provided to adjust the tension and length of the strap 65. The fastening mechanism 45 is, for example, of the snap-fit type. The user after threading the strap 65 through the clamp 85 will then pull the strap 65 around the second side of the first member 40*a* so that the strap can be removably connected to the snap-fit fastening mechanism 45. The fastening mechanism 45 can be, for example, snap-fit or slide-fit. The slide-fit fastening mechanism 45 is similar to the snap-fit fastening mechanism 45 except that the slide-fit fastening mechanism 45 is attached to a piece of material that moves laterally along a track that is attached to the second side of the first member 40*a*. A strap 65 with fewer holes is used when the modular apparatus 5 has a slide-fit fastening mechanism 45.

Figure 12A:
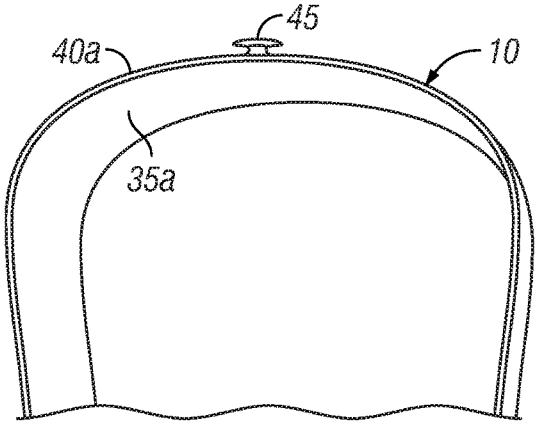
FIG. 12A illustrates a partial top view of a first member of a modular apparatus, according to an embodiment.
Figure 12B:
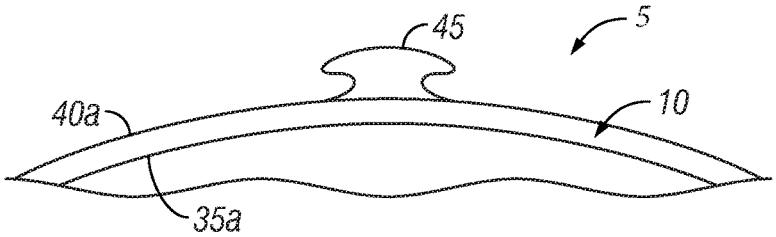
FIG. 12B illustrates an enlarged view from FIG. 12A of a first member of a modular apparatus and a fastening mechanism, according to an embodiment.
Figure 12C:
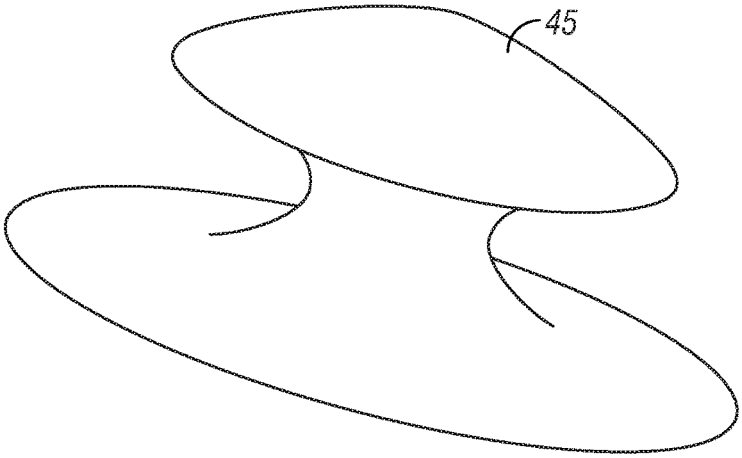
FIG. 12C illustrates an enlarged detail-view from FIG. 12B of a fastening mechanism, according to an embodiment.

FIG. 12A illustrates a top view of a first member 10 according to an embodiment, wherein the snap-fit version of the fastening mechanism 45 is connected to the second side of the first member 40*a*. The snap-fit version of the fastening mechanism 45 is connected substantially in the middle of the first member 10. FIG. 12B illustrates an enlarged view from FIG. 12A of a first member 10 of a modular apparatus 5 and a snap-fit fastening mechanism 45, according to an embodiment. In one aspect, the snap-fit fastening mechanism 45 is permanently connected to the second side of the first member 40*a*. The snap-fit fastening mechanism 45 is shaped similarly to a button; however other shapes can be contemplated. FIG. 12C illustrates an enlarged detail-view from FIG. 12B of a snap-fit or slide fit fastening mechanism 45, according to an embodiment. The fastening mechanism 45 can be attached directly to one surface of the second side of the first member 40*a* or it can be attached directly to a piece of material that moves laterally along a track that is attached to the second side of the first member 40*a*.

Figure 13:
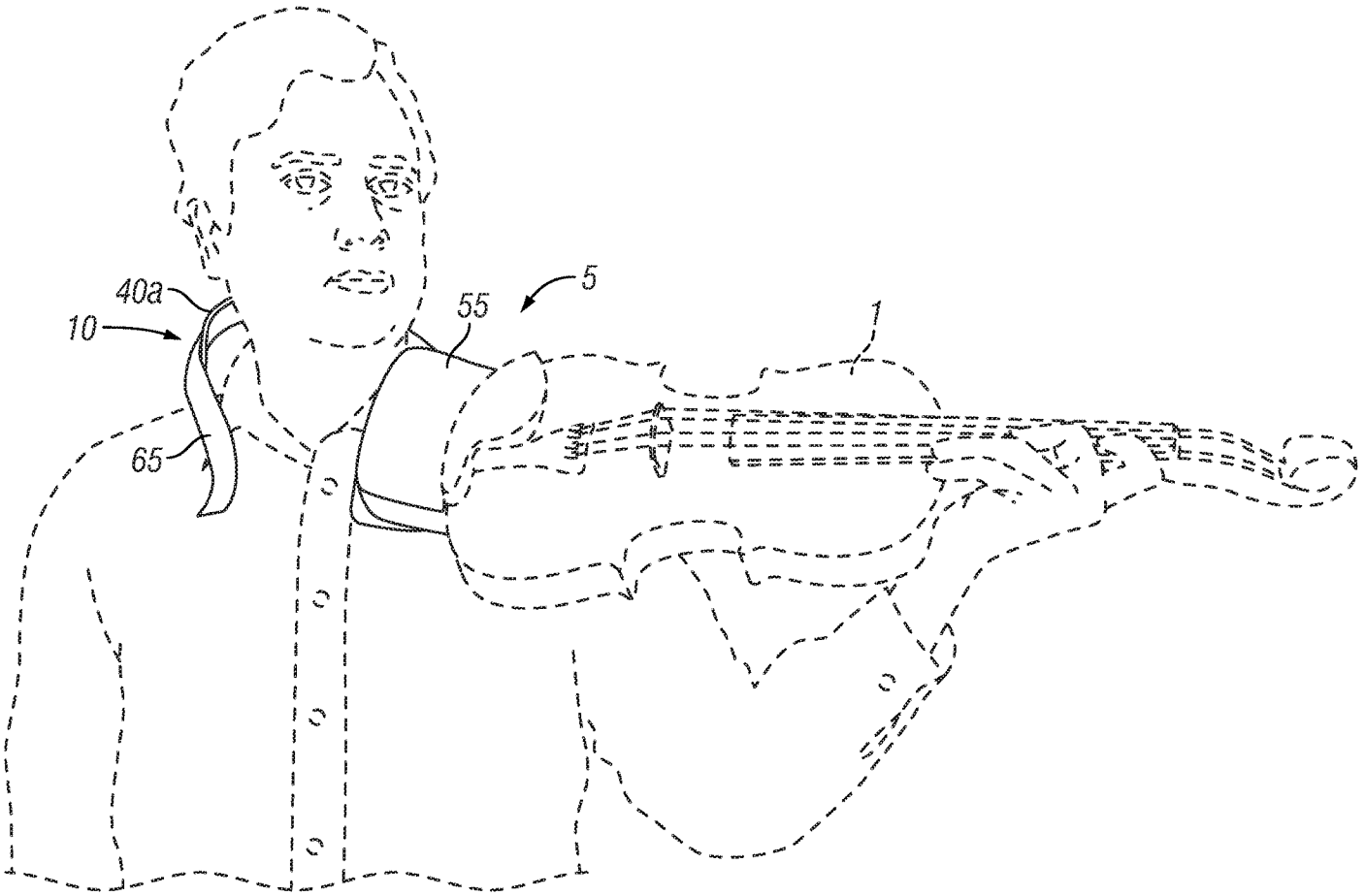
FIG. 13 illustrates a modular apparatus being used with a violin, according to an embodiment.

FIG. 13 illustrates a modular apparatus 5 being used with a violin 1, according to an embodiment. The first member 10 is configured to partially curve around the user's neck and the second member 15 (not shown, see FIG. 1) is configured to curve over the user's left shoulder. After the strap 65 is inserted through the clamps 85, the violin 1 is brought up against the support 55 and the strap 65 is extended around the second side of the first member 40*a* and fastened with a fastening mechanism 45 (not shown, see FIG. 1) located on the second side of the first member 40*a*.

While particular embodiments of the present invention have been shown and described, it will be obvious to those of skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A modular apparatus for self-supporting a musical instrument comprising:

a neck member configured to hang from a neck, the neck member extending to a first shoulder member, which is configured to hang from a shoulder;

the neck member and the first shoulder member are at about 90 degrees to each other;

the neck member having a first side and a second side, the first shoulder member having a first side and a second side;

at least one support attachment on the second side of the neck member; and a second shoulder member being a mirror image of the first shoulder member comprising a first side and a second side.

2. The apparatus of claim 1, wherein the second shoulder member is about 90 degrees to the neck member.

3. The apparatus of claim 2, wherein the second shoulder member is substantially parallel to the first shoulder member.

4. A modular apparatus for self-supporting a musical instrument comprising:

a neck member configured to hang from a neck, the neck member extending to a first shoulder member, which is configured to hang from a shoulder;

the neck member and the first shoulder member are at about 90 degrees to each other;

the neck member having a first side and a second side, the first shoulder member having
a first side and a second side;

at least one support attachment on the second side of the neck member; and a strap-lock button on the second side of the first shoulder member.

5. The apparatus of claim 1, further comprising a strap-lock button on the second side of the second shoulder member.

6. A modular apparatus for self-supporting a musical instrument comprising:

a neck member configured to hang from a neck, the neck member extending to a first shoulder member, which is configured to hang from a shoulder;

the neck member and the first shoulder member are at about 90 degrees to each other;

the neck member having a first side and a second side, the first shoulder member having
a first side and a second side;

at least one support attachment on the second side of the neck member; and a wedge removably attached to the support attachment.

7. A modular apparatus for self-supporting a musical instrument comprising:

a neck member configured to hang from a neck, the neck member extending to a first shoulder member, which is configured to hang from a shoulder;

the neck member and the first shoulder member are at about 90 degrees to each other;

the neck member having a first side and a second side, the first shoulder member having
a first side and a second side;

at least one support attachment on the second side of the neck member; and wherein the second side of the neck member comprises a snap-fit fastening mechanism.

8. A modular apparatus for self-supporting a musical instrument comprising:

a neck member configured to hang from a neck, the neck member extending to a first shoulder member, which is configured to hang from a shoulder;

the neck member and the first shoulder member are at about 90 degrees to each other;

the neck member having a first side and a second side, the first shoulder member having
a first side and a second side;

at least one support attachment on the second side of the neck member; and a strap.

9. A modular apparatus for self-supporting a musical instrument comprising:

a neck member configured to hang from a neck, the neck member extending to a first shoulder member, which is configured to hang from a shoulder;

the neck member and the first shoulder member are at about 90 degrees to each other;

the neck member having a first side and a second side, the first shoulder member having
a first side and a second side;

at least one support attachment on the second side of the neck member; and wherein the second side of the neck member comprises a slide fit fastening mechanism.

10. The apparatus of claim 1, made of a flexible material.

11. The apparatus of claim 1, made of a moldable material.

12. The apparatus of claim 1, made of an elastic material.

13. A modular apparatus for self-supporting a musical instrument comprising:

a neck member extending at about a 90 degrees to a first shoulder member and the neck member extending at about 90 degrees to a second shoulder member, the first shoulder member being a mirror image of the second shoulder member;

the neck member, the first shoulder member, the second shoulder member each having a first side and a second side; and the neck member having at least one support attachment on the second side.

14. The apparatus of claim 13, wherein the support attachment is removably attached to a wedge.

15. The apparatus of claim 13, further comprising a strap.

16. The apparatus of claim 13, wherein the second side of the neck member comprises a snap-fit fastening mechanism.

17. The apparatus of claim 13, wherein the second side of the neck member comprises a slide fit mechanism.

18. The apparatus of claim 13, formed of a material that is flexible.

19. The apparatus of claim 13, formed of a material that is moldable.

* * * * *